US005832701A

United States Patent [19]

Hauers et al.

[11] Patent Number: 5,832,701

[45] Date of Patent: Nov. 10, 1998

[54] VERTICAL BAG FORMING, FILLING AND SEALING MACHINE

[76] Inventors: Manfred Hauers, Alt-Breyeller Weg 21, D-41751 Viersen, Germany; Dieter Vits, Buchsbaumstrasse 11, D-41470 Neuss, Germany

[21] Appl. No.: 751,167

[22] Filed: Nov. 15, 1996

[30] Foreign Application Priority Data

Dec. 21, 1995 [DE] Germany ..... 195 47 860.6

[51] Int. Cl.[6] ..... B65B 9/06

[52] U.S. Cl. ..... 53/551; 53/451; 53/289

[58] Field of Search ..... 53/550, 551, 552, 53/553, 554, 451, 567, 434, 512, 289

[56] References Cited

U.S. PATENT DOCUMENTS

| | | | |
|---|---|---|---|
| 3,543,467 | 12/1970 | Leasure | 53/552 |
| 3,738,080 | 6/1973 | Reil | 53/551 |
| 4,338,765 | 7/1982 | Ohmori et al. | 53/289 |
| 4,353,196 | 10/1982 | Beer et al. | 53/552 |
| 4,996,825 | 3/1991 | Bacon et al. | 53/451 |
| 5,054,270 | 10/1991 | McMahon | 53/552 |
| 5,505,037 | 4/1996 | Terminella et al. | 53/552 |

FOREIGN PATENT DOCUMENTS

| | | |
|---|---|---|
| 2 251 476 | 6/1975 | France . |
| 1 187 980 | 2/1965 | Germany . |
| 114 040 | 11/1974 | Germany . |
| 25 53 853 | 6/1977 | Germany . |

*Primary Examiner*—Daniel Moon
*Assistant Examiner*—John Paradiso
*Attorney, Agent, or Firm*—Herbert Dubno

[57] ABSTRACT

A vertical bag forming, filling and sealing machine having a feed system for a wrapping material forming the flexible tube bags, a filling tube, a longitudinal seam welding device and a cross seam welding device is described. The cross seam welding device comprises a unit forming the lower cross weld seam and a unit forming the upper cross weld seam of a flexible tube bag. The unit for generating the upper cross weld seam or a folding device and a lifting device for the filled flexible tube bag are movable up and down and are lifted for the generation of the upper cross weld seam or for the folding of the flexible tube bag in order to relax the wrapping material. By this the air space over the surface of the filling material is kept as small as possible.

12 Claims, 6 Drawing Sheets

VERTICAL BAG FORMING, FILLING AND SEALING MACHINE

FIELD OF THE INVENTION

The present invention relates to a vertical bag; forming, filling and sealing machine comprising a feed system for a wrapping material forming the flexible tube bags, a filling tube around which the wrapping material is fed for the formation of a flexible tube and which serves for filling of the material to be packed into the bag, a longitudinal seam welding device and a cross seam welding device for the formation of a lower and an upper cross weld seam to close the flexible tube bag.

BACKGROUND OF THE INVENTION

Vertical bag-making and filling machines are know. The wrapping material, coming as a flat web from a roll, is transported around the filling tube by a feed system. During this transport the wrapping material is formed into a flex tube in which the longitudinal seam is welded. Then a lower cross weld seam is generated, and the formed bag is filled with the material to be packaged by means of the filling tube. Finally, the upper cross weld seam is formed and the complete filled bag is separated from the flexible tube.

With the known vertical bag-forming, filling and sealing machines a cross seam welding device simultaneously generates the lower cross weld seam of the flexible tube fed around the filling tube and the upper cross weld seam of the filled bag which is located beneath the low cross weld of the next bag to be filled.

The filling tube can have a round or rectangular shape. The term "welding" is used here is to refer both to the formation of the weld and also the sealing of the wrapping material with a continuous seam or an interrupted seam. Commercially available and customary foils are used as wrapping materials, for instance polypropylene, polyethylene, aluminum combinations, paper and other multi-layer foils, which can be manufactured in various bag formats. In addition to the welding devices, corresponding folding devices, air pushers or other members, for instance knives, can be provided.

The known vertical bag forming, filling and sealing machines operating in this manner have the disadvantage that the upper cross weld seams can be arranged only at a relative large distance from the surface of the filling material so that the upper parts of the flexible tube bags have a roof-like shape in their upper portion. The reason for this is that, when the upper cross weld seam is made, the freely hanging foil of the filling tube is applied with stresses by the inward movement of the weld jaws. In other words, additional foil material is pulled up from below by the inward movement of the weld jaws in order to brine together the two foil sides over the filling material. Normally, when the foil sides are brought together only angles with a value of up to 45° can be obtained, i.e. smooth close sitting of the foils to the filling material is not achieved. A relative large air space can remain over the filling material.

Indeed, it is also known to provide corresponding air pushers (air removers) which remove the undesired air. However, even with these measures one could not achieve close fitting of the foil to the filling material in the upper portion of the flexible tube bag. Accordingly, disadvantages had to be accepted that the packed filling material was able to dislocate within the flexible tube bag, thereby causing stacking problems and the like.

OBJECTS OF THE INVENTION

It is an object of the invention to provide a vertical bag-forming, filling and sealing machine of the type described with which the upper cross weld seams at the flexible tube bags can be provided as close as possible to the surface of the filling material. In other words, it is an object to manufacture flexible tube gags manufactured which have the smallest possible air space over the surface of the filling material.

SUMMARY OF THE INVENTION

According to the invention these objects are attained with a bag-forming, filling and sealing machine in which a. the cross seam welding device comprises two separate units independent from ore another and one of which generates the lower and cross weld seam, the other of which generates the upper cross weld seam of the flexible tube bag;

b. the machine includes a lifting device for the filled flexible tube bag not yet provided with the upper cross weld seam;

c. the unit for the generation of the upper cross weld seam is movable up and down; and d. the lifting device and the unit for the generation of the upper cross weld seam are driven and/or controlled in such a manner that the unit and the filled flexible tube bag are lifted relative to the unit for the generation of the lower cross weld seam and the filling tube for the generation of the upper cross weld seam.

The apparatus is thus designed to lift the filled flexible tube bag not yet provided with the upper cross weld seam together with the unit for the generation of the upper cross weld seam relative to the filling tube and the unit for the generation of the lower cross weld seam in order to relax the wrapping material forming the flexible tube bag and to arrange more wrapping material in the range of the upper cross weld seam so that the wrapping material can be moved radially inwardly substantially stress-free by the unit for the generation of the upper cross weld seam (weld or seal jaws) . Since enough material is present in this region it is possible to fold down the wrapping material close to the surface of the filling material so that nearly no air space remains over the surface of the filling material. Accordingly, the upper cross weld seam can be arranged with an especially small distance from the surface of the filling material.

In order to realize the above-cited two movements of the lifting device and of the unit for the generation of the upper cross weld seam, both of these units can have the same drive means or can have different drive means. The velocities with which both members are moved can be the same or different.

In the simplest case the lifting device and the unit for the generation of the upper cross weld seem are driven and/or controlled in such a manner that both are lifted for the same distance. In this case there is no relative movement between the unit for the generation of the upper cross weld seam and the surface of the filling material in vertical direction. However, this means that with this embodiment the unit for the generation of the upper cross weld seaming device has to be located relative close to the surface of the filling material in order to achieve a folding with a close fit in this range with a cross weld seam arranged close to the surface of the filling material. Accordingly, this embodiment is suitable substantially only for machines with which a constant level of the filling material can be assured. This is the case with filling materials with a relatively stable shape and/or with very exactly operating machines. Of course, in this case the unit for the generation of the upper cross weld seam approaches the flexible tube bag laterally and puts the wrapping material over the surface of the filling material from a lateral direction. If the levels of the filling material are different problems can arise.

In another embodiment of the invention the lifting device and the unit for the generation of the upper cross weld seam are driven and/or controlled in such a manner that the unit is lifted only over a part of the length of stroke of the lifting device. In other words, with this embodiment during the lifting movement of the filled flexible tube bag a relative movement between the surface of the filling material and the unit for the generation of the upper cross weld seam can occur in the vertical direction. In this case the velocity of the lifting movement carried out by the lifting device is greater than that of the unit for making the upper cross weld seam since the lifting device travels over a greater distance. Of course, in this embodiment the upper cross weld seamer has to be spaced from the surface of the filling material in the lower position of the lifting device and the unit so that in the upper end position the unit for the generation of the upper cross weld seam sits close to the filling surface. Accordingly, with this embodiment the upper cross weld seamer lies against the surface of the filling material from above since it also moves radially inwardly during the lifting movement. Accordingly, the wrapping material can be folded inwardly absolutely stress-free in a nearly ideal manner.

Of course, combinations of the two embodiments described above are also possible.

In an especially preferred embodiment, the lifting device is lifted for a distance which corresponds to the width of the flexible tube bag. This solution can be used for both cases described above. In the first case also the unit for the generation of the upper cross weld seam is lifted through a distance which corresponds to the width of the flexible tube bag. In the second case the unit for the generation of the upper cross weld seam is preferably lifted through a distance which corresponds to half of the width of the flexible tube bag. It has already been mentioned that the unit for the generation of the upper cross weld seam is preferably driven and/or controlled in such a manner that it moves radially inwardly during the upward movement, At the end of the upward movement of the lifting device and of the unit for the generation of the upper cross weld seam the unit for the generation of the upper cross weld seam has also reached its end point of inward movement so that the folding process of the wrapping material is terminated and the cross weld seam can be generated. In other words, then the two weld jaws or seal jaws of the unit for the generation of the upper cross weld seam have reached their radially innermost points and can weld or seal together the two sides of the wrapping material.

The unit for the generation of the upper cross weld seam can be formed as a true welding device or sealing device and can include weld jaws or seal jaws for the generation of a continuous weld seam. Alternatively, it can be designed seal seam or for the generation of an interrupted seam. Preferably, the unit is provided with a suitable folding device which can include one or more folding members, for instance a side folder. Such folding members are known. By this, a correct folding in the region of the upper cross weld seam is guaranteed.

Of course, for instance also two cross weld seams can be located one above the other in order to form a carrying handle. In this case an aperture or a slot is produced in the region between the two cross weld seams by means of a suitable cutting means. It is always essential that the wrapping material is folded in adaption to the filling level in order to achieve a packing as free as possible from air. As mentioned above, the air space over the filling material is to be minimized in order to obtain a product which is as stable as possible and which has a high packing density and good stacking ability.

According to the invention the unit for the generation of the upper cross weld seam is adjustable relative to the lifting device with regard to the height. This embodiment can respond to variations of the filling level in a flexible manner, i. e. the unit for the generation of the upper cross weld seam can be adapted to the respective filling level, for instance in response to a signal supplied by a sensor detecting the filling level, in order to obtain a fold fitting close to the surface of the filling material.

For the solution of the problem to provide an air space over the surface of the filling material which is as small as possible another embodiment of an inventive bag forming, filling and sealing machine is characterized by the features that a. a folding device for the wrapping material is provided at the upper end portion of the flexible tube bag below the cross seam welding device;

b. the machine has a lifting device for the filled flexible tube bag not yet provided with the upper cross weld seam;

c. the folding device is movable up and down; and d. the lifting device and the folding device are driven and/or controlled in such a manner that the folding device and the filled flexible tube bag are lifted relative to the unit for the generation of the cross weld seams and the filling tube for folding the wrapping material.

This embodiment is substantially designed as the previously described embodiment. Deviating from the previously described embodiment is substantially only the feature that an upwardly and downwardly movable folding device is provided instead of the upwardly and downwardly movable unit for generating the upper cross weld seam. According to this embodiment the unit for generating the upper cross weld seam can be formed together with the unit for generating the lower cross weld seam, i.e. in a stationary manner in vertical direction Only the folding device is lifted together with the filled flexible tube bag so that the wrapping material can be folded on the surface of the filling material in a stress-free manner in the upper range of the flexible tube bag. Then, a true upper cross weld seam is generated by the folding device, i.e. the flexible tube bag has a somewhat longer upper end portion than with the previously described embodiment. However, by the folding step the air is pressed out of this portion so that, in spite of the location of the upper cross weld seam at a higher position, a package is achieved which is relatively stable with regard to its shape.

Moreover, all the variants of the previously described embodiment are applicable to present embodiment. As mentioned above, in the first embodiment the unit for generating the upper cross weld seam carries out a true folding process while the upper cross weld seam can be conventionally generated by a device which forms not only the lower but also the upper cross weld seam. Furthermore, according to this embodiment several upper cross weld seams can be generated, too. In any case, the folding device provides for a close fitting of the wrapping material to the surface of the filling material and thus causes the desired pressing-out of air.

Preferably, the folding device itself can include two folding jaws and can be formed in a corresponding manner as the above-described welding unit. However, also other embodiments of folding devices can be used. It is only essential that the folding device is lifted in connection with the filled flexible tube bag.

BRIEF DESCRIPTION OF THE DRAWING

The above and other objects, features, and advantages will become more readily apparent from the following description, reference being made to the accompanying drawing in which:

FIG. 3 is a vertical section through a part of the vertical bag-forming, filling and sealing machine of the FIGS. 1 and 2, wherein the left half of the figure shows the lowered and the right half of the figure shows the lifted condition of the lifting device and the unit for generating the upper cross weld seam;

FIG. 5 is a horizontal section through the unit for generating the lower cross weld seam; FIG. 6 is a horizontal section through the unit for the generation of the upper cross weld seam.

SPECIFIC DESCRIPTION

Figure 1:
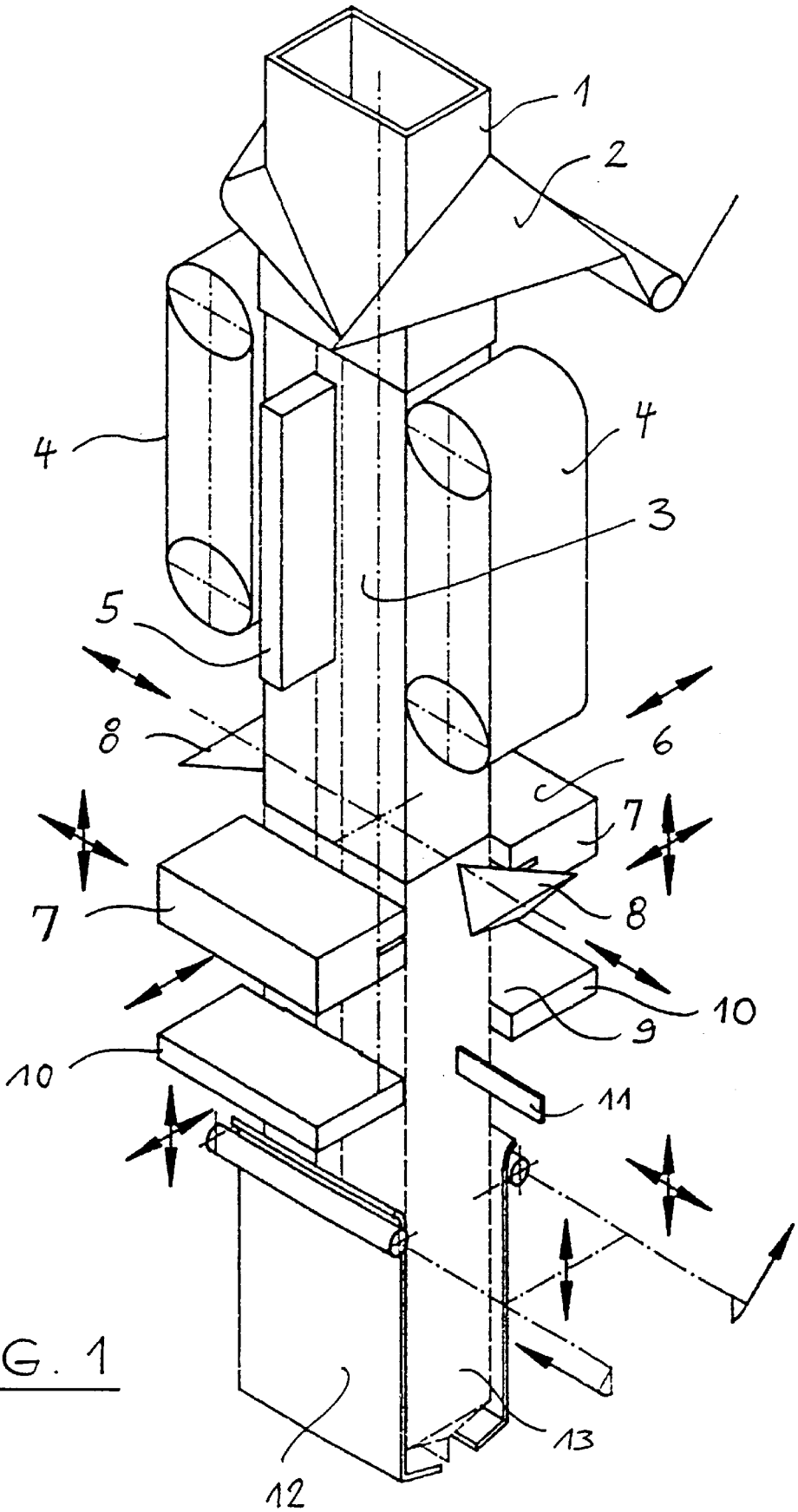
FIG. 1 is a diagrammatic perspective view of a part of a vertical bag forming, filling and sealing machine, wherein the lifting device and the unit for generating the upper cross weld seam are shown in a first lowered position.

FIG. 1 shows the essential components of a vertical bag-forming, filling and sealing machine which are of interest for the present invention. A suitable wrapping material 2, consisting for instance of polyethylene, is laid around a rectangular filling tube 1 by means of a feed system (not shown) so that a flexible tube 3 is formed. Suitable conveying means 4, which are shown as endless belts, move the flexible tube intermittently in the figure from above to below. A longitudinal seam welding device 5 welds together the edges of the wrapping material.

A unit 6 for generating a lower cross weld seam (bottom seam) is slightly spaced from the lower end of the filling tube 1. This unit is associated with two side folders 8. The unit 6 for generating the lower cross weld seam has two weld jaws 7 which press the two sides of the formed flexible tube 3 against one another by a radially inwardly directed movement and weld the same. The side folders 8 have moved inwardly together with the weld jaws 7 so that a proper rim results at the lower end of the flexible tube bag.

Figure 2:
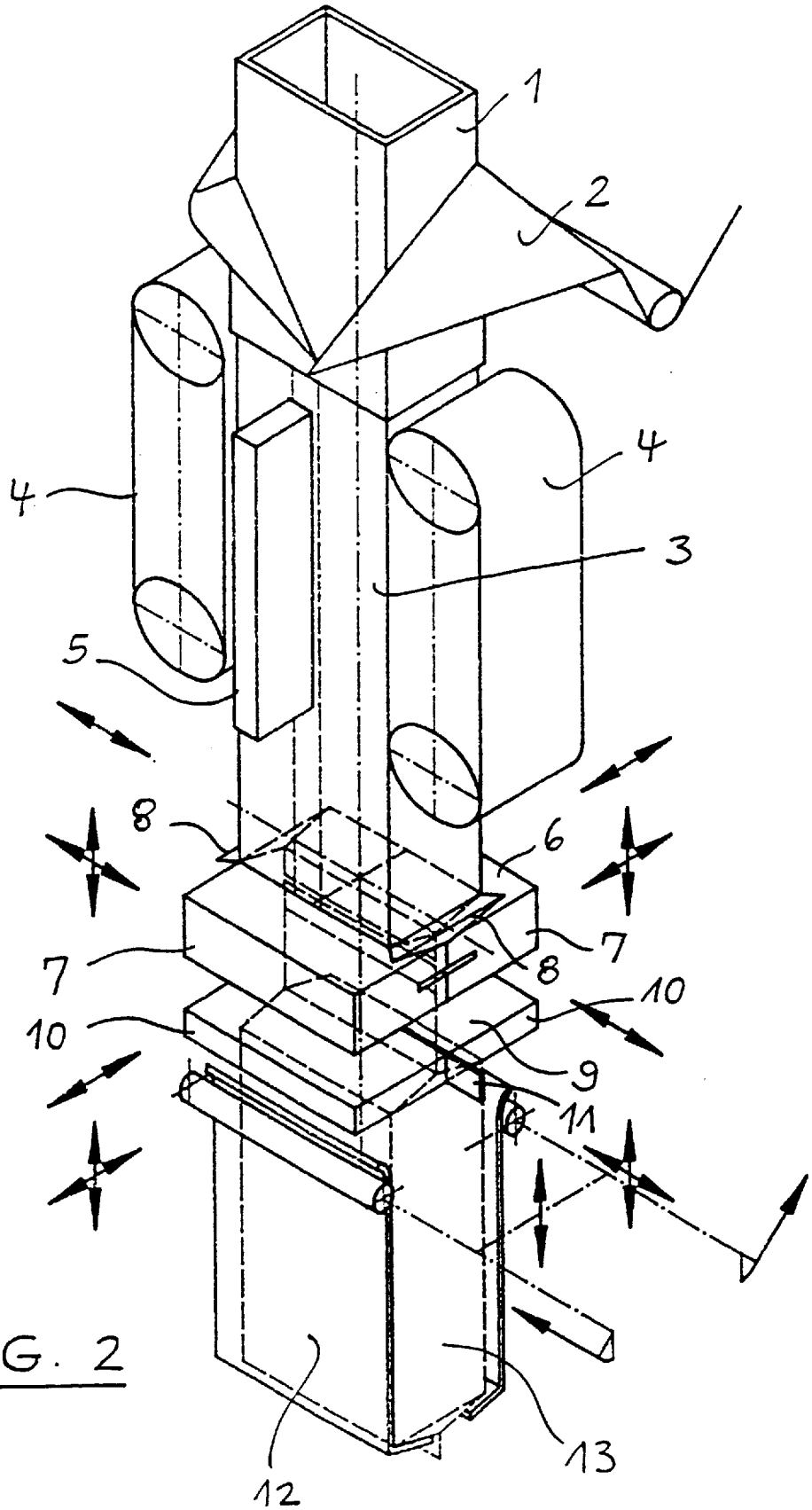
FIG. 2 is a similar view according to which, however, the lifting device and the unit for generating the upper cross weld seam are shown in a second lifted position.

FIG. 2 shows the weld jaws 7 in their condition moved together and the side folders 8 in their condition moved inwardly.

After the generation of the lower cross weld seam the filling material is filled into the flexible tube 3 which is still open above The filling device with a suitable weighing device is not shown and does not form a part of the present invention.

The upper cross weld seam of the flexible tube bag located thereunder is generated simultaneously with the generation of the lower cross weld seam of the overlaying package. This upper cross weld seam forms the upper end of the finished flexible tube bag which is then separated from the flexible tube by means of a suitable cutting device. As shown in FIG. 1, a unit 9 for generating the upper cross weld seam (head seam) is located below the unit 6 for generating the lower cross weld seam. The unit 9 has also two radially inwardly and outwardly movable weld jaws 10. This unit 9 is also associated with a side folder 11.

Figure 3:
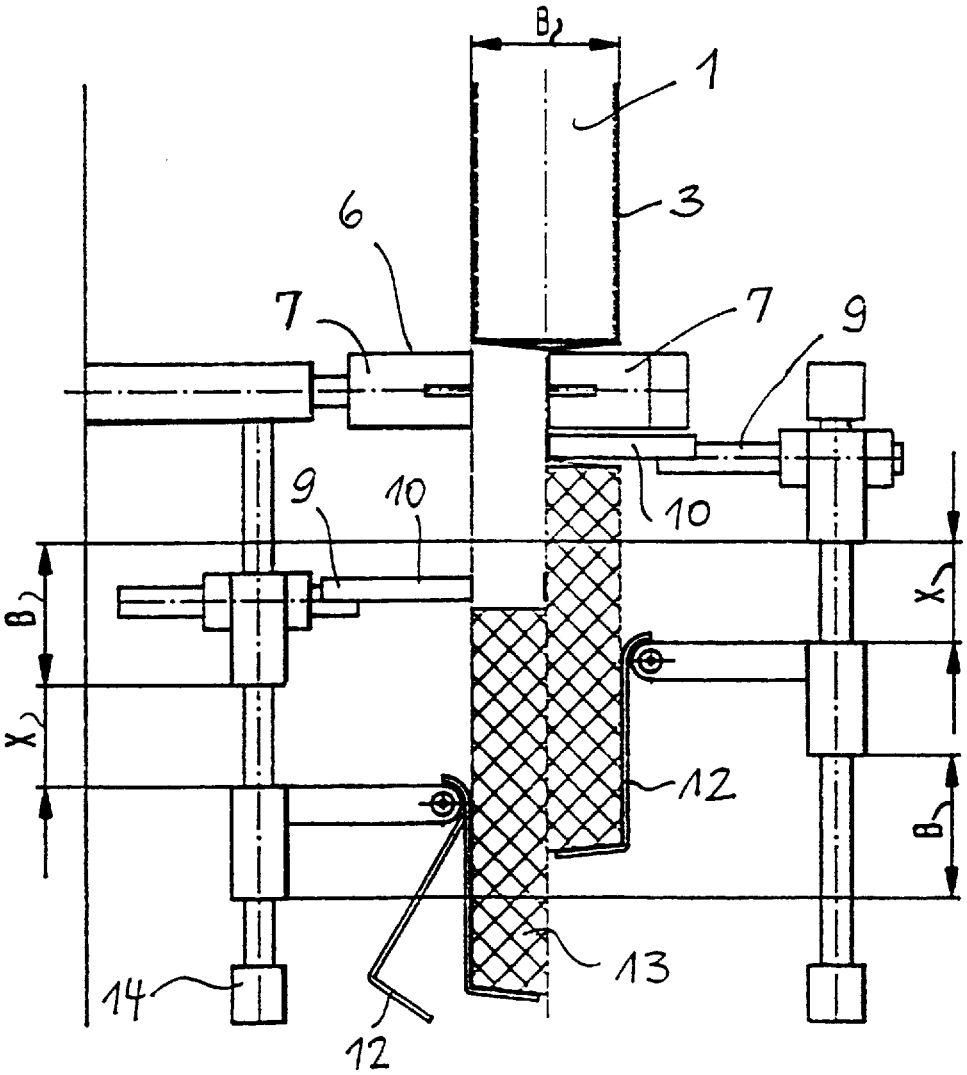
FIG. 3 shows

The flexible tube bag already provided with a cross weld seam at its lower end and filled with filling material 13 rests in a lifting device 12. For the generation of the upper cross weld seam the flexible tube bag with the filling material 13 and the unit 9 for generating the upper cross weld seam are lifted so that the position shown in FIG. 3 is reached. During the lifting movement the two weld jaws 10 of the unit 9 for generating the upper cross weld seam move radially inwardly so that the wrapping material is folded radially inwardly. When terminating the lifting movement the welding process is carried out. The side folder 11 (only shown from one side) has been moved inwardly in a corresponding manner. By the fact that not only the flexible tube bag with filling material but also the unit 9 for carrying out the welding process are lifted a stress-free folding of the wrapping material in the upper range of the flexible tube portion and a stress-free welding are possible so that one succeeds in bringing the wrapping material as close as possible to the surface of the filling material. Accordingly, packages can be made which are very stable with respect to their shape.

After the generation of the upper cross weld seam the finished flexible tube bag is separated from the flexible tube. The flexible tube bag falls on a suitable transport belt by opening of the lifting device.

FIG. 3 shows the operation of the lifting device 12 and of the unit 9 for generating the upper cross weld seal in detail with a first embodiment. On the left side of the figure the lifting device 12 and the unit are shown in the lowermost position while they are shown in the uppermost position on the right side of the figure. For carrying out the folding and welding process the lifting device 12 lifts the flexible tube bag provided with the filling material 13 for the distance B which corresponds to the width of the flexible tube bag. Simultaneously the unit 9 for generating the upper cross weld seam is lifted for the distance B, i.e. the right and left weld jaws 10 in the figure are lifted. During the lifting movement of the unit 9 the two weld jaws 10 move radially inwardly and reach the innermost end position shown in the right half of the figure in which the welding process is carried out. In this position which corresponds to the uppermost position the weld jaws 10 are slightly below the weld jaws 7 of the unit 6 for generating the lower cross weld seam. In the lower most position shown in the left half of FIG. 3 the weld jaws 10 are only slightly above the surface of the filling material 13 so that the folding process of the wrapping material is substantially carried out by a true lateral movement of the weld jaws 10. Since not only the lifting device but also the unit 9 move for the distance B a single drive means 14 for both parts can be used. Finally, FIG. 3 shows the lifting device 12 in a swung out condition.

Figure 4:
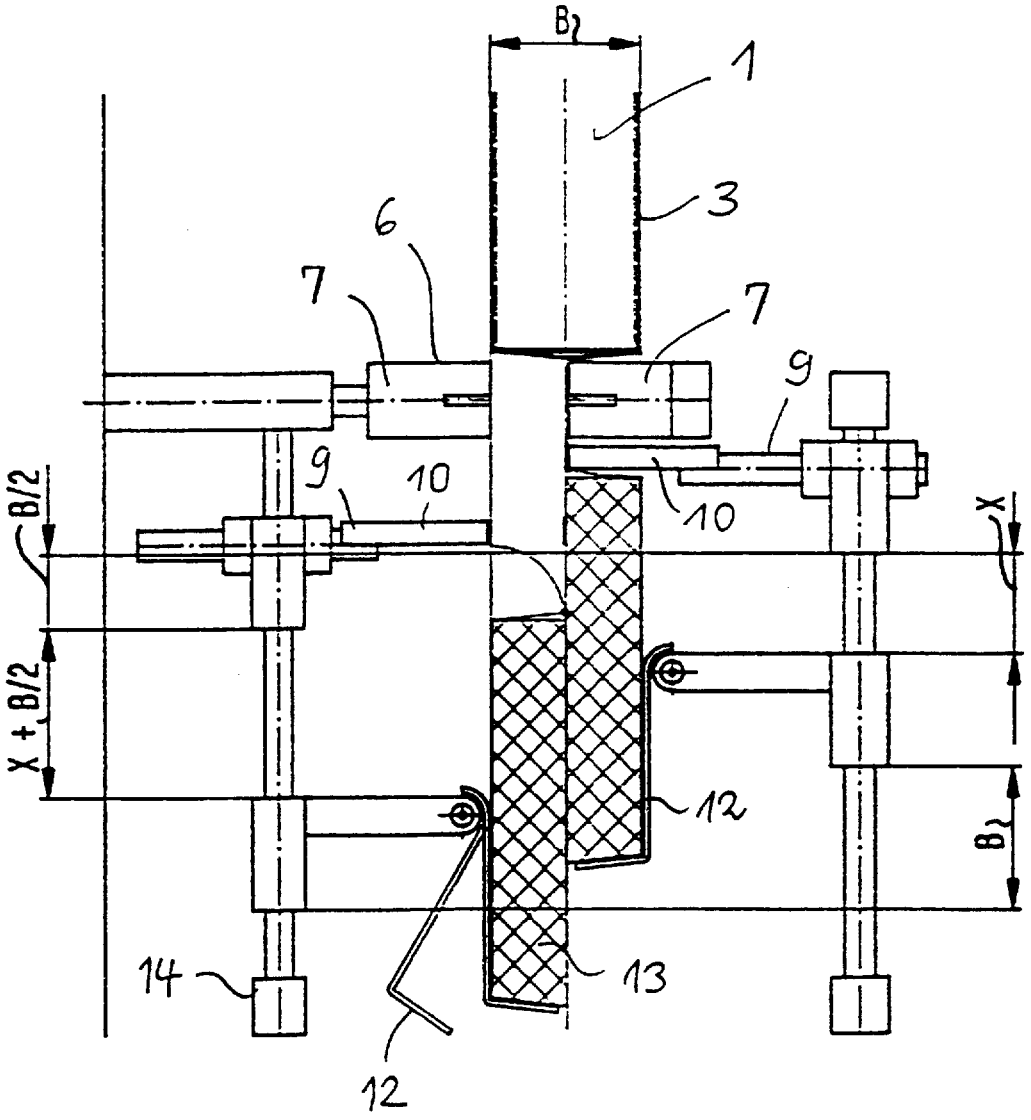
FIG. 4 is a view similar to FIG. 3 but of another FIG. 3, however, wherein another embodiment of the invention.

The embodiment shown in FIG. 4 substantially corresponds to that of FIG. 3 with the only difference that the lifting device 12 and the unit 9 for generating the upper cross weld seam move for different distances and thus with different velocities. According to this embodiment the lifting device 12 moves for the distance B, as with the embodiment of FIG. 3, while the unit 9 moves only for the distance B/2. In the lowermost position of the lifting device 12 and the unit 9 shown in FIG. 4 the unit 9 is spaced from the surface of the filling material by a distance of B/2. As shown in the right half of FIG. 4, this distance has been nearly consumed in the uppermost position of the unit 9 and of the lifting device 12. Also in this case the two weld jaws 10 of the unit 9 move radially inwardly during the lifting movement until they reach the end position shown in the right half of FIG. 4. One recognizes that in this embodiment the weld or fold jaws lie from above onto the surface of the filling material and do not carry out an exclusive lateral movement as with the embodiment of FIG. 3. Accordingly, the wrapping material can be adapted to the surface of the filling material with close fit in a completely stress-free manner.

Figure 5:
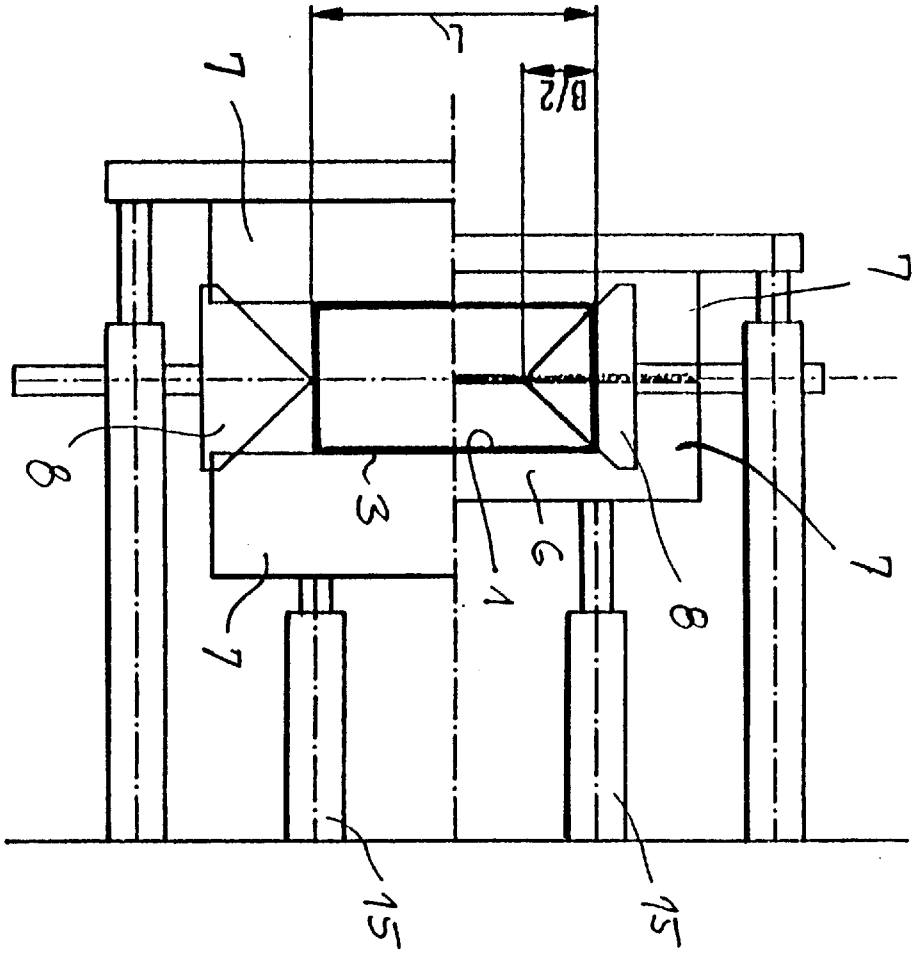
FIG. 5 shows

FIG. 5 shows a cross-section through the machine in the range of the unit for generating the lower cross weld seam. The two weld jaws 7 are shown in the closed position in the upper half of the figure while they are shown in the open position in the lower half. A drive means 15 provides for the corresponding transverse movement of the weld jaws 7. Furthermore, one recognizes triangularly shaped side folders 8 which are moved inwardly in the figure from above and from below in order to fold the wrapping material in a suitable manner.

Figure 6:
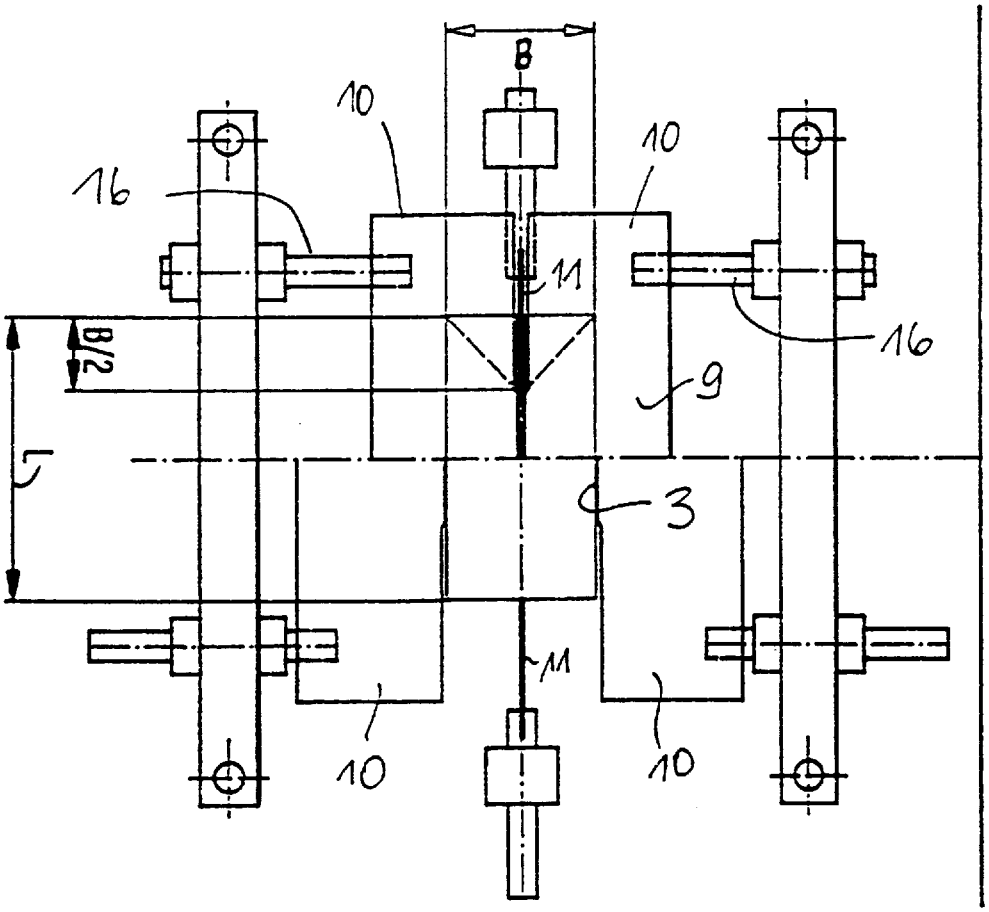
FIG. 6 shows

FIG. 6 shows a cross-section of the machine in the region of the unit 9 for generating the upper cross weld seam. Also in this case the two weld jaws 10 are shown in the closed condition in the upper range of the figure while they are shown in the open condition in the lower range. Furthermore, one recognizes the suspending flexible tube 3 which is folded radially inwardly by the weld jaws 10 from both sides. A corresponding drive means 16 provides for the inward and outward movement of the weld jaws 10. The side folder 11 consisting of two members is also shown.

The above-described example is also true for an embodiment of the invention according to which a folding device is provided instead of the liftable unit for generating the upper cross weld seam. In this case, the member 9 is formed by the folding device, and the member 6 is formed by a unit for generating the lower and the upper cross weld seam. Moreover, the same structure and the same operation are present.

With the above-described embodiments shown in FIGS. 1 to 6, the unit 6 generates only the lower cross weld seam (bottom seam) of a flexible tube bag which is not yet filled. However, it is clear that this unit 6, in addition to this lower seam (bottom seam) can also generate in a standardized manner an upper seam (head seam) of the flexible tube bag thereunder For this, the unit 6 has preferably two double jaws including two superposed weld jaws, respectively. In addition to the upper cross weld seam produced with the unit 9 in an inventive manner another cross weld seam positioned thereabove is generated. Thereafter, a separation between the two cross weld seams generated by the double jaws 7 is carried out.

In principle, the unit 6 can only generate the lower cross weld seam (bottom seam) of a flexible tube bag not yet filled or this lower cross weld seam and an additional upper cross weld seam (head seam) of a filled flexible tube bag located thereunder. This is independent of the upper cross weld seam generated by the unit 9 or independent of a folding unit provided instead of this unit.

Furthermore, with the inventive machine the portion of the flexible tube bag remaining above the upper cross weld seam can be shortened arbitrarily by means of knives additionally provided.

We claim:

1. A vertical bag forming, filling and sealing machine comprising:

a feed system for a wrapping web forming the flexible tube bags;

a filling tube around which the wrapping web is fed for the formation of a flexible tube and which serves for filling a material which is to be packed into the tube;

a longitudinal seam welding device for welding said web into said tube;

a cross seam welding device for the formation of a lower and an upper cross weld seams on said tube, thereby forming bags therebetween, said cross seam welding device being divided into two separate independently operable units including a first unit for producing the lower cross weld seam of and a second unit producing the upper cross weld seam of and a lifting device is provided for the lifting each filled bag before it is provided with the upper cross weld seam;

the unit for producing the upper cross weld seam is movable up and down; and the lifting device and the second unit for producing the upper cross weld seam are driven, and controlled in such a manner that the second unit and the filled bag are lifted relative to the first unit and the filling tube.

2. The machine according to claim 1 wherein the lifting device and the second unit are driven and controlled in such a manner that both are lifted for the same distance.

3. The machine according to claim 1 wherein the lifting device and the second unit are driven and controlled in such a manner that the second unit is lifted only for a part of the stroke distance of the lifting device.

4. The machine according to claim 1 wherein the lifting device is lifted for a distance which corresponds to a width of the flexible tube.

5. The machine according to claim 4 wherein the second unit is lifted for a distance which corresponds to half of the width of the flexible tube.

6. The machine according to claim 1 wherein the second unit is formed with a folding device.

7. The machine according to claim 1 wherein the second unit is driven and controlled in such manner that it moves radially inwardly during upward movement.

8. The machine according to claim 1 wherein the second unit is provided with a cutting device for the wrapping web.

9. The machine according to claim 1 wherein the second unit is adjustable in its height relative to the lifting device.

10. The machine according to claim 1 wherein in a lower position of the lifting device the second unit is spaced from the surface of the filling material by a distance which is taken up by the lifting movement of the lifting device and of the second unit.

11. A vertical bag forming, filling and sealing machine comprising a feed system for a wrapping material forming the flexible tube bags, a filling tube around which the wrapping material is fed for the formation of a flexible tube and which serves for filling of the material which is to be packed, a longitudinal seam welding device and a cross seam welding device for the formation of a lower and an upper cross weld seam at a flexible tube bag, wherein:

a. a folding device for the wrapping material is provided below the cross seam welding device at an upper end portion of the flexible tube bag;

b. the machine includes a lifting device for a filled flexible tube bag not yet provided with the upper cross weld seam;

c. the folding device is movable up and down; and d. the lifting device and the folding device are driven and controlled in such a manner that the folding device and the filled flexible tube bag are lifted relative to the unit for generating the cross weld seams and the filling tube for folding the wrapping material onto the surface of the filling material.

12. The machine according to claim 11 wherein the folding device has two fold jaws.

* * * * *